US007380844B2

(12) United States Patent
Berghahn et al.

(10) Patent No.: US 7,380,844 B2
(45) Date of Patent: Jun. 3, 2008

(54) LOCK FOR DOORS AND LIDS ON VEHICLES

(75) Inventors: Jörg Berghahn, Gelsenkirchen (DE); Lothar Schemberg, Essen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 11/660,180

(22) PCT Filed: Jun. 22, 2005

(86) PCT No.: PCT/EP2005/006737

§ 371 (c)(1),
(2), (4) Date: Feb. 14, 2007

(87) PCT Pub. No.: WO2006/021253

PCT Pub. Date: Mar. 2, 2006

(65) Prior Publication Data

US 2007/0205613 A1 Sep. 6, 2007

(30) Foreign Application Priority Data

Aug. 19, 2004 (DE) ..... 10 2004 040 157

(51) Int. Cl.
*E05C 3/06* (2006.01)

(52) U.S. Cl. ..... 292/201; 292/216

(58) Field of Classification Search ..... 292/216, 292/201, DIG. 23; 49/280
See application file for complete search history.

(56) References Cited

U.S. PATENT DOCUMENTS 4,395,064 A * 7/1983 Bellot et al. ..... 292/201
5,433,496 A * 7/1995 Zimmermann ..... 292/201

(Continued)

FOREIGN PATENT DOCUMENTS

DE 101 33 092 1/2003

(Continued)

*Primary Examiner*—Gary Estremsky
(74) *Attorney, Agent, or Firm*—Friedrich Kuffner

(57) ABSTRACT

In a lock fitted with a rotary latch (30), a detent (40) is provided that can engage inside a preliminary catch and inside a main catch (32) of the rotary latch (30). The rotary latch (30) receives a locking part and can be transferred either manually or by means of a motor between an open position, a preliminary catch position and a main catch position (30.2). The motor-driven displacement ensues via a closing aid or an opening aid. In order to obtain a space-saving design, the invention provides that a locking lever (10) is eccentrically mounted on the rotary latch (30) and is held in a central position by an impulse spring whereby functioning as a closing aid. A stationary, rotationally mounted driving element (50) serves an opening aid, and an opening lever (20) is rotationally mounted on this driving element. This opening lever (20) is also held in a central position by an impulse spring. The locking lever (10) projects inside the preliminary catch position always in the path of rotation of the eccentric (21) and is entrained in one direction when the motor turns. In an analogous manner, the opening lever (20) projects into the main catch position (30.2) in the path of rotation of the eccentric (21) and is entrained in the opposite direction during rotation (23). The entrained opening lever (20) pushes, via the driver (50), the detent (40) from the rotary latch (30), whereby the door is opened by a motor.

15 Claims, 7 Drawing Sheets

U.S. PATENT DOCUMENTS

Figure 2A:
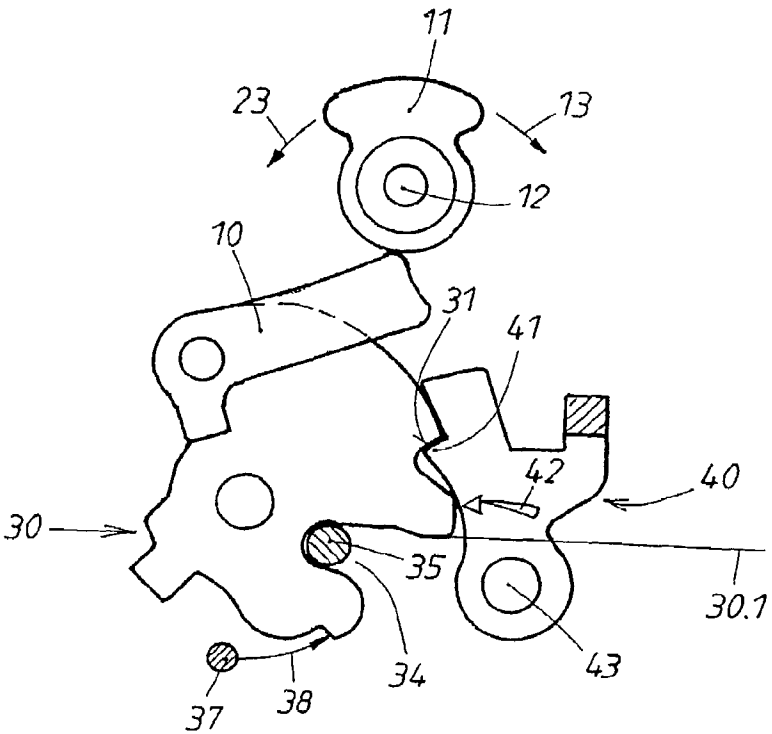

| | | | | |
|---|---|---|---|---|
| 5,769,468 | A * | 6/1998 | Armbruster | 292/201 |
| 5,876,074 | A * | 3/1999 | Dowling | 292/201 |
| 5,938,252 | A * | 8/1999 | Uemura et al. | 292/201 |
| 6,048,002 | A * | 4/2000 | Ohta et al. | 292/201 |
| 6,079,237 | A * | 6/2000 | Hochart | 70/278.6 |
| 6,411,302 | B1 * | 6/2002 | Chiraz | 345/545 |
| 6,422,615 | B1 * | 7/2002 | Roos et al. | 292/216 |
| 6,550,825 | B2 * | 4/2003 | Ostrowski et al. | 292/199 |
| 6,565,131 | B2 * | 5/2003 | Roos | 292/201 |
| 6,568,720 | B1 * | 5/2003 | Szablewski | 292/201 |
| 6,659,515 | B2 * | 12/2003 | Raymond et al. | 292/201 |
| 6,805,386 | B2 * | 10/2004 | Ehret et al. | 292/216 |
| 7,032,937 | B2 * | 4/2006 | Boecker et al. | 292/201 |
| 7,111,878 | B2 * | 9/2006 | Kachouh | 292/216 |

FOREIGN PATENT DOCUMENTS

| | | |
|---|---|---|
| EP | 0 478 013 | 4/1992 |
| FR | 2 803 619 | 7/2001 |

* cited by examiner

LOCK FOR DOORS AND LIDS ON VEHICLES

The invention pertains to a lock of the type indicated in the introductory clause of Claim 1. The lock is normally located in the area of the door or hatch and has a rotary latch. A closing part, which travels into the rotary latch when the door or hatch is closed manually, is located on the door post. The closing part then pivots the latch initially out of a spring-loaded open position into a prelatching position. The lock and the closing part could also be installed in the opposite way, of course, on the door and on the door post.

The prelatching position of the rotary latch is secured by a stationary, rotatably supported pawl, which is spring-loaded toward the rotary latch and drops into a pre-catch in the rotary latch. A reversible motor, furthermore, with an associated control unit for turning the motor on and off, is also provided. The motor works together both with a motorized door-closing or hatch-closing aid and with a motorized door-opening or hatch-opening aid by way of a gearbox with at least one cam. By means of the door-closing or hatch-closing aid, the rotary latch is moved by the cam into a main latching position, which is also secured by the pawl. In the main latching position, the pawl drops into a main catch provided on the rotary latch.

Locks with a motorized opening and closing aid are known (WO 98/27301 A2) in which the gearbox has two takeoff routes, between which a gearbox part is installed with freedom to pivot. This lock has been found to be reliable, but it is expensive and bulky.

A lock of the type cited in the introductory clause of Claim 1 which has a less expensive design than the previously mentioned prior art is known from DE 101 33 092 A1. In this known lock, the gearbox of the motor remains engaged at all times and acts on two cams, one of which works together directly with the rotary latch, while the other cam works directly with the pawl. The cam and the parts of its gearbox must be installed far enough away from each other that, when the cam acting as a door-closing aid rotates, the other cam moves freely with respect to the pawl. The opposite is true for the other cam of the door-opening aid. For this purpose, a sufficient amount of room must be provided in the lock. If, during the closing process, the electronic control unit, the motor, and/or the power supply fails between the prelatching position and the main latching position, the occupants of the vehicle are locked inside, even if someone on the outside were to perform emergency mechanical actuation. In this lock, the rotary latch is held in, for example, a so-called "overstroke" position by the cam even when the pawl is actuated mechanically.

It is also known (U.S. Pat. No. 4,395,064) that a closing lever can be mounted rotatably and eccentrically on a rotary latch, whereas an opening lever is mounted similarly on a pawl. This lever, however, does not have a middle position, which is predetermined by springs or control surfaces. In addition, the rotary latch has only a single catch and no pre-catch.

In principle, it is also known (DE 37 21 274 T2/EP 0 478 013 B1) that a lever can be preloaded by an impulse spring. In this lock, however, neither a door-closing aid nor a door-opening aid is provided.

The invention is based on the task of developing a reliable lock of the type indicated in the introductory clause of Claim 1 which can be designed to occupy a relatively small amount of space and which can also be actuated even if the electronic system fails. This is accomplished according to the invention by the measures listed in Claim 1, to which the following special meaning attaches.

Both in the case of the door-closing aid and in the case of door-opening aid, the cam or cams act only indirectly on the rotary latch and on the pawl. A closing lever of the closing aid rotatably supported eccentrically on the rotary latch and an opening lever of the opening aid rotatably supported on a stationary but rotatably supported driver work together with the cams. Both the closing lever and the opening lever are held in a defined middle position by impulse springs. In this middle position, the cam works together with the closing lever only in the prelatching position and moves the rotary latch into its main latching position when the cam is turned in one direction. When the rotary latch is in its main latching position or in its open position, the closing lever is located outside the rotational path of the cam is therefore not actuated.

A corresponding situation exists for the opening lever. In the main latching position, the working end of the opening lever is in the rotational path of the cam. Although the opening lever is free to move, the cam can exert torque on the driver when the cam rotates in the opposite direction. As a result, the pawl is carried along and lifted out of the main latching position of the rotary latch. The rotary latch is then moved by its own spring loading into its open position. Profiles and opposing profiles between the opening lever and the cam ensure that the rotary latch has enough time to do this. Both in the open position and in the prelatching position, however, the opening lever is positioned by the driver in such a way that, upon rotation of the cam in one direction, the opening lever is pushed away, against the action of its impulse spring, and exerts no actuating force on the driver. After the cam has passed by, the opening lever returns to its middle position under the action of its impulse spring. On rotation in the opposite direction, the opening lever is gripped by the cam and pushes the driver and thus the pawl back. Both in the open position and in the prelatching position, furthermore, an open gap is present between a shoulder on the driver and an opposing shoulder on the pawl.

If two separate cams are used, one for the closing aid and one for the opening aid, these can, according to the invention, be located very close together, as a result of which space is saved in the lock. It is especially economical with respect to space, however, for the two cams to be aligned axially and mounted on a common gearbox output of the motor.

Further measures and advantages of the invention can be derived from the subclaims, from the drawings, and from the following description. In the drawings, an exemplary embodiment of the invention is illustrated schematically in various positions on the basis of the most important parts of the lock. The views are plan views from the inside of the rear hatch. The lock housing has been omitted.

Figure 1A:
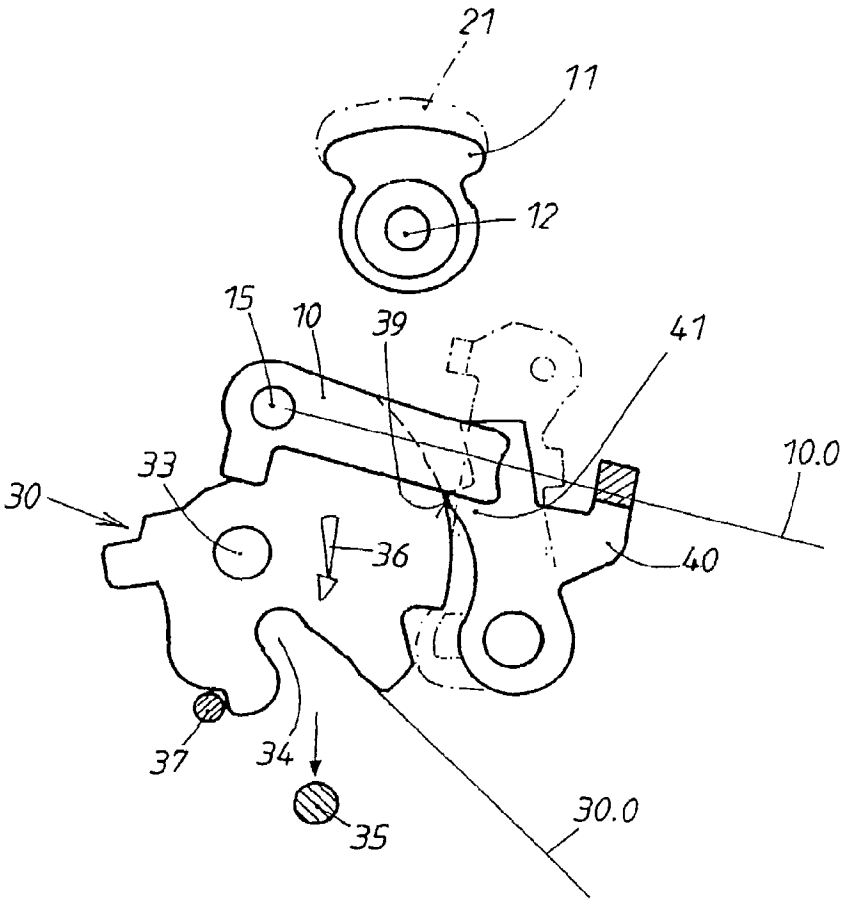
Figure 4A:
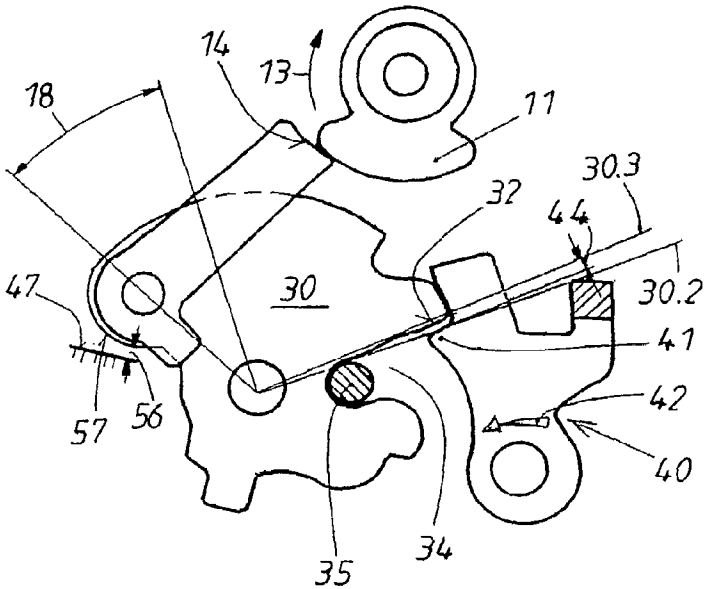
Figure 3A:
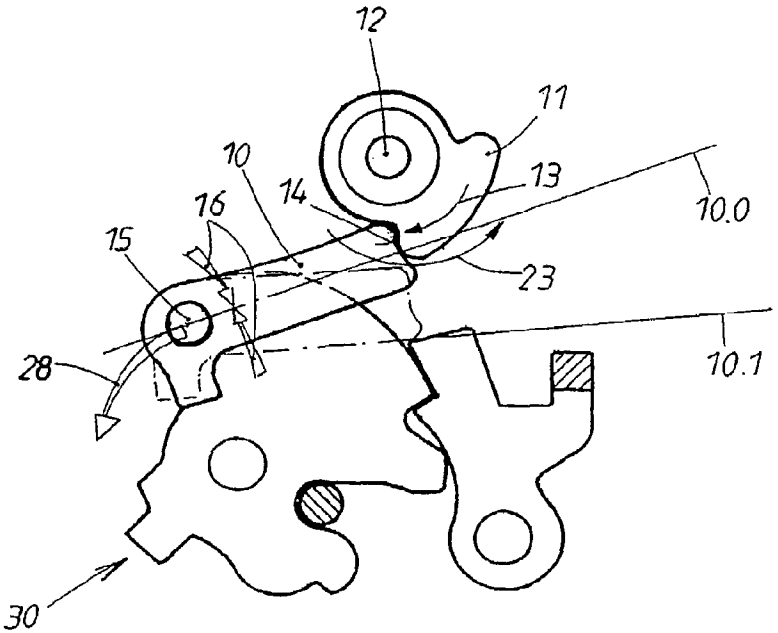
Figure 6B:
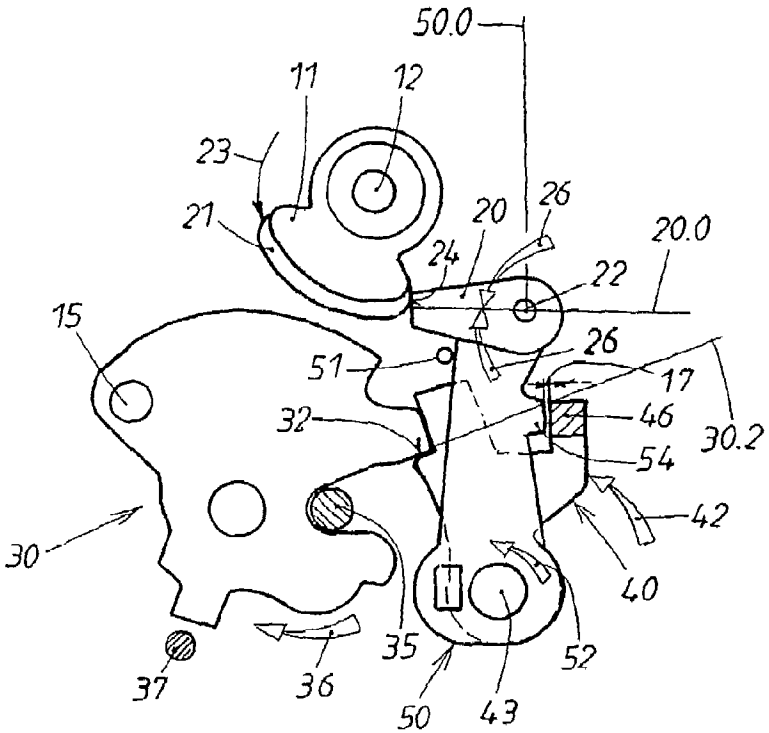
Figure 6A:
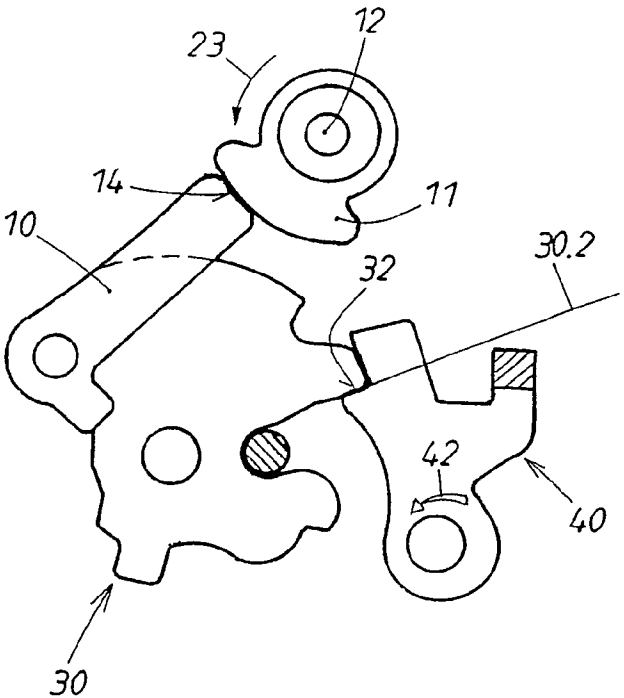
Figure 5A:
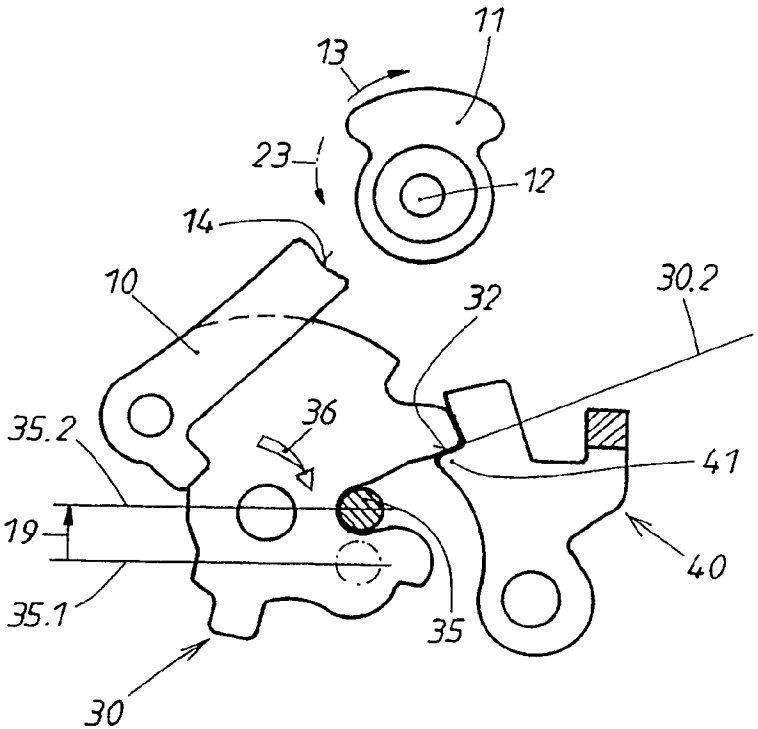
Figure 8A:
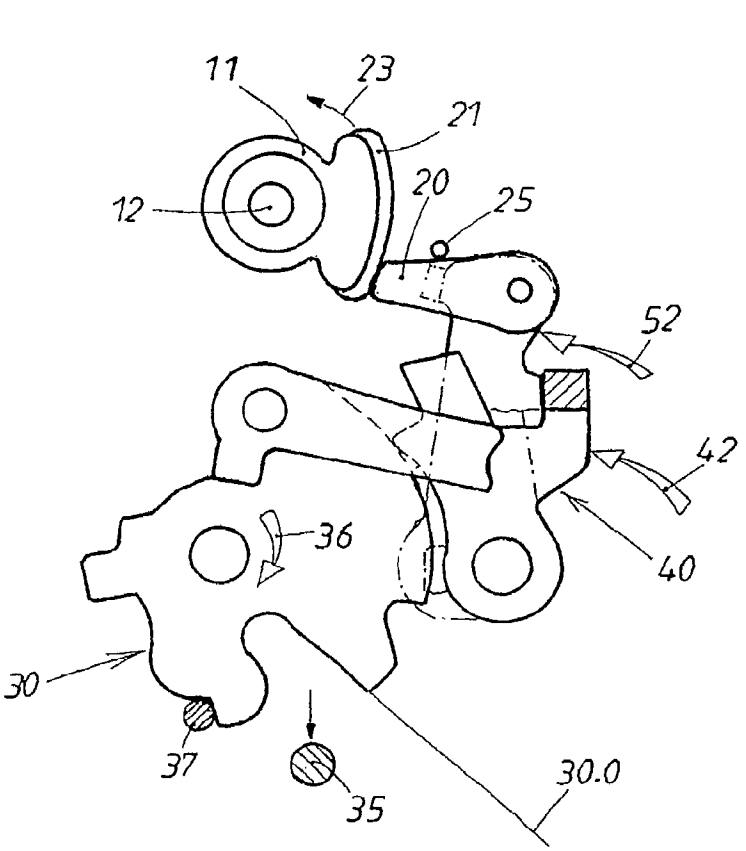
Figure 7A:
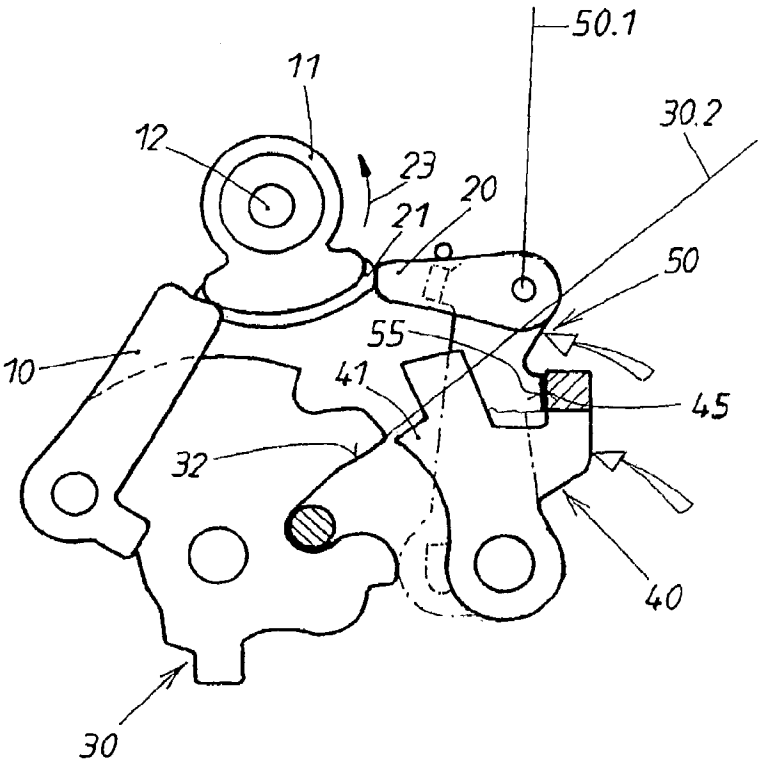
Figure 10A:
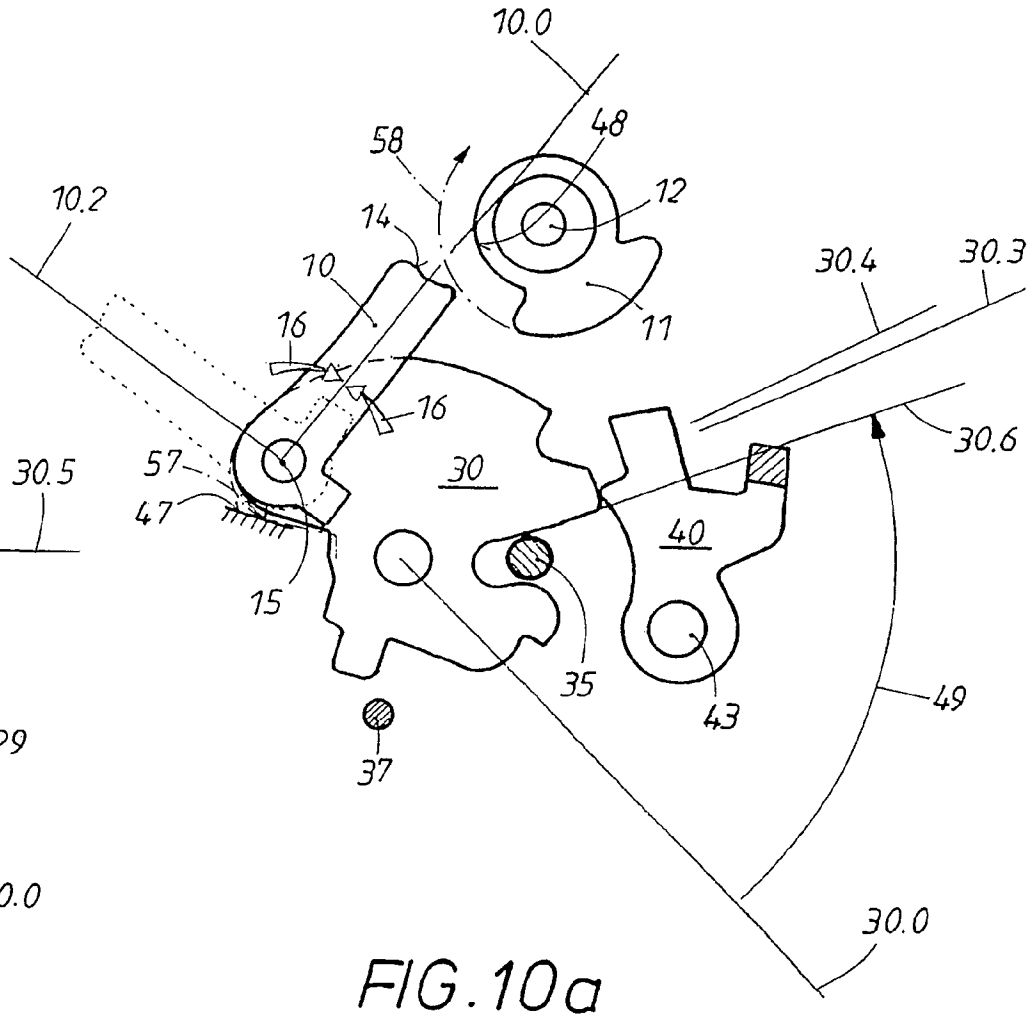
Figure 9A:
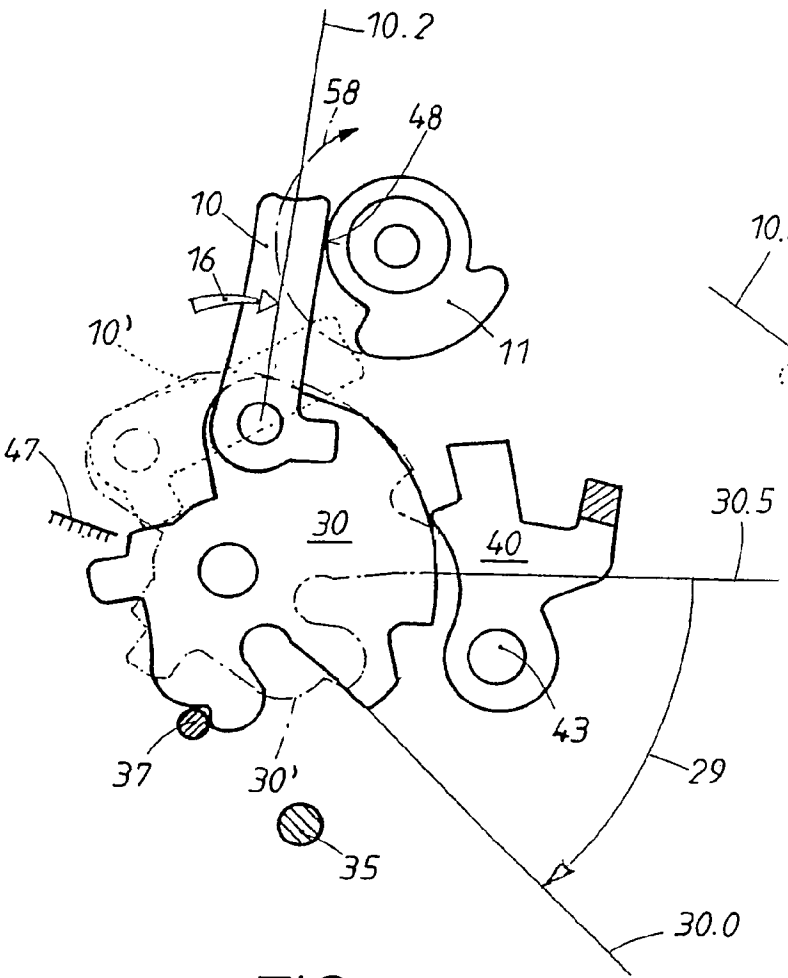

FIGS. 1*a*-8*a* show only the parts of the lock which are actuated by a first cam, acting by way of a closing lever. The other lock parts located on a plane in front of the closing lever have been omitted from FIGS. 1*a*-8*a*, although some of them are suggested in dash-dot line. In FIGS. 3*b*-8*b*, however, where the opening aid is active, they are shown as solid parts. FIGS. 3*b*-8*b* show an opening lever, which is controlled by a second cam. In FIGS. 3*b*-8*b*, the closing lever of the preceding FIGS. 1*a*-8*a* has been left out for the most part and is illustrated only in FIG. 3*b*. Specifically:

FIG. 1*a* shows the open position of the lock, which is fastened to the rear hatch of a vehicle, i.e., the position which the lock assumes when the hatch is open;

FIG. 2*a* shows a prelatching position with a partially closed hatch;

FIGS. 3*a*+3*b* show the initial phase of the operation of a closing aid;

FIG. 4*a* shows the final phase of the operation of the closing aid, where the lock has arrived in a so-called "overstroke" position;

FIG. 5*a* shows a main latching position of the lock parts, i.e., the position which is present after the hatch has been properly closed;

FIGS. 6*a*+6*b* show the initial phase of the operation of a motorized opening aid for the lock, the rotary latch still being in its main latching position;

FIG. 7*a* shows an intermediate phase of the operation of the opening aid, where, although the rotary latch has already been released by a pawl, it is still being held in its main latching position by the closing lever and its cam;

FIGS. 8*a*+8*b* show the final phase of the operation of the motorized closing aid, where the opening lever is still being held by its cam, but the closing lever has been released by its cam, thus allowing the rotary latch to be returned to the open position of FIG. 1*a*, which characterizes an opened hatch;

FIG. 9*a* shows an emergency situation, where, after the failure of the motorized closing aid, the rear hatch can be opened manually; and FIG. 10*a* shows the emergency situation of FIG. 9*a* during supplemental manual actuation to bring the closing aid back into its starting position, in which the lock is ready again for future motorized operation.

A rotary latch 30, which has a profiled notch 34 to accept a closing part 35, is seated on a first stationary axis 33 of a lock housing (not shown). The closing part 35 can be designed as a pin or as the web of a yoke and is seated on the stationary door post. The lock housing, however, is mounted on the movable hatch, but, as previously mentioned, it is not shown in the drawings. The rotary latch 30 is acted upon by a spring (not shown), which acts in the direction of the force arrow 36 of FIG. 1*a*. The spring-loading 36 tries to keep the rotary latch pressed against a stationary stop 37 in the housing. In this situation, the rotary latch is in the "open" position, characterized by the auxiliary line 30.0 in FIG. 1*a*, in which the closing part 35 is released. The hatch can now be raised or lowered.

When the hatch is swung down to close it, the closing part 35 travels into the notch 34 according to FIG. 2*a* and turns the rotary latch 30 in the direction of the rotational arrow 38 shown there until the locking end 41 of a pawl 40 travels into a pre-catch 31 in the rotary latch 30. The pawl 40 is also supported on a stationary axis 43 in the lock housing and is also spring-loaded. The spring-loading in this case tries to move the pawl in the direction of the force arrow 42 against the rotary latch 30. In FIG. 2*a*, the rotary latch 30 is in a "prelatching position", illustrated by the auxiliary line 30.1. In the open position of FIG. 1*a*, the locking end 41 of the pawl 40 rests elastically against a point 39 on the periphery of the rotary latch 30.

Let it be assumed that the rotary latch is in the prelatching position of FIG. 2*a* and that the motorized closing aid now goes into action. This aid consists of a motor with an electrical control unit and a gearbox (not shown). A first cam 11 is seated on the output shaft of the gearbox. The motor can turn in either direction. In the prelatching position of FIG. 2*a*, the cam 11 now rotates in the direction indicated by the rotational arrow 13. In the drawings, this rotational direction 13 is the clockwise direction. As this rotation proceeds, the cam 11 strikes the butt end 14 of a closing lever 10, which is pivotably supported on a hinge point 15 of the rotary latch 30. The closing lever 10 is spring-loaded with respect to the rotary latch 30 by way of an impulse spring (not shown), which tries to keep the lever in a "middle position", illustrated by the auxiliary line 10.0. The action of this impulse spring is illustrated by the pair of arrows 16 in FIG. 3*a*. If the output shaft 12 were to turn in the opposite direction 23, that is, in the counterclockwise direction, as will be explained below on the basis of FIG. 3*b*, the closing lever 10 would pivot into a working position 10.1, illustrated in dash-dot line in FIGS. 3*a* and 3*b*. After the cam 11 has passed by, the lever would then return to its middle position 10.0 by the action of the impulse spring 16. When, during the previously mentioned rotational, i.e., clockwise, movement 13, the cam 11 strikes the butt end 14 of the closing lever 10, it will exert on the rotary latch 30 the torque indicated by the arrow 28 in FIG. 3*a*.

The action of this torque 28 is illustrated in FIG. 4*a*; the rotary latch 30 has been pivoted further by the motor around the angle 18. During this further rotation 18, the cam 11 slides along the butt end 14, which has a compatible shape. During this further rotation 18, finally, the locking end 41 of the pawl 40 drops behind the main catch 32 provided on the rotary latch 30. The main catch 32 in the present case is formed by a profile contour of the notch 34, into which the closing part 35 fits. So that the pawl 40 will always drop reliably behind the main catch 32, the pivoting movement 18 of the rotary latch is greater than actually necessary, this extra amount of pivoting being termed the "overstrokel" of the rotary latch. This overstroke defines an "overstroke position" of the rotary latch 30, illustrated by the auxiliary line 30.3 in FIG. 4*a*. In this overstroke position 30.3, there is in fact an air gap 44 present between the main catch 32 of the rotary latch and the locking end 41 of the pawl.

There is a stationary stop 47 in the lock, which works together with a shoulder 57 on the rotary latch 30 in a manner which will be described in greater detail below in conjunction with FIG. 10*a*. In the present overstroke position 30.3, there is also an air gap 56 present between the stop 47 and the shoulder 57.

As the cam 11 continues to execute the rotation 13 in the clockwise direction of the drawings, it first releases the butt end 14 of the closing lever 10. The spring-loading 36 then allows the rotary latch 30 to turn backward slightly, until its main catch 32 rests against the locking end 41 of the pawl. This is shown in FIG. 5*a*. The rotary latch is now in its "main latching position", illustrated by the auxiliary line 30.2 in FIG. 5*a*. This main latching position 30.2 is also indicated in FIG. 4*a*. Starting from its prelatching position, which is indicated in dash-dot line in FIG. 5*a* and illustrated by the height line 35.1, and which is also the position shown in FIGS. 2*a* and 3*a*, the closing part 35 travels the distance 19 and thus arrives in the position 35, indicated in solid line, marked by the height line 35.2 in FIG. 5*a*. The hatch equipped with the lock has been pulled inward by the distance 19 against the action of the elastic door seals. The electrical control unit turns the motor off when the cam 11 has reached, for example, the "12 o'clock position" shown in FIG. 5*a*, which is preferably the same as the starting position of FIG. 1*a*. In FIG. 5*a*, the hatch has been properly closed, as designed.

The lock, however, is also provided with a motorized opening aid, so that it can be opened conveniently from the main latching position 30.2 of FIG. 5*a*. The opening aid is controlled by the same motor and, in the present case, by the same gearbox as well. For this purpose, a second cam 21, shown in FIG. 6*b*, is used, which lies in a plane different from that of the previously described first cam 11. In the present exemplary embodiment, however, this second cam is seated on the same output shaft 12 as the first cam. As an alternative, the two cams 11, 21 could be seated on two different gearbox elements of the motor, located a certain radial distance away from each other. The opening aid begins when an authorized person turns the motor on by way of a switch or by remote actuation, but the motor now rotates in the previously mentioned opposite direction 23 of FIG. 5*a*, i.e., in the counterclockwise direction. Because, as previously mentioned, both cams 11, 21 are mounted on the same output shaft 12, and both of them rotate in the opposite, i.e., counterclockwise, direction 23. The first cam 11 executes the no-load pivoting 10.1 of the closing lever 10, only part of which is shown there, explained previously on the basis of FIG. 3*b*, but then, as FIG. 6*b* shows, it works together with the additional lock parts of the opening aid.

A driver 50 is seated on a stationary axis 43, which, in the present case, is also that of the pawl 40. The driver 50 is spring-loaded in the same direction as the pawl 40, i.e., toward the rotary latch 30, although it lies in a plane in front of the rotary latch 30. The pawl 40 lies in the same plane as the rotary latch 30. The driver 50 has a backward-extending tab 54, which works together with a projecting arm 46 of the pawl 40. In the no-load state, the driver 50 rests by reason of its spring-loading 52 against an end stop (not shown) and thus assumes the rest position illustrated by the auxiliary line 50.0 in FIG. 6*b*. In the rest position 50.0, which is still present in FIG. 6*b*, an air gap 17 can be present between the tab 54 and the arm 46.

Figure 8B:
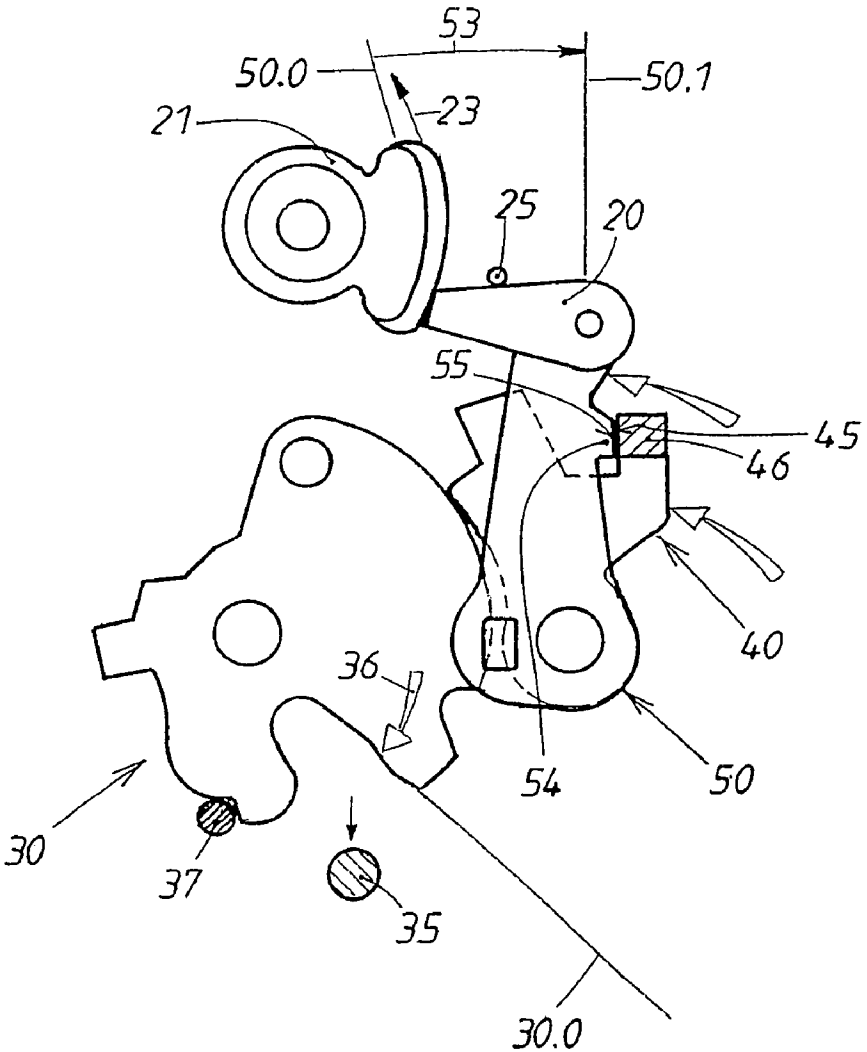

At the free end 51 of the driver, an opening lever 20 is seated on a hinge point 22. The opening lever 20 is also provided with an impulse spring (not shown), the action of which is again illustrated by the pair of arrows 26 in FIG. 6*b*. The impulse spring 26 ensures that the opening lever 20 is held in a defined middle position, illustrated by an auxiliary line 20.0 in FIG. 6*b*. In the course of the previously mentioned opposite rotation 23, the second cam 21 strikes the butt end 24 of the opening lever 20. The moment of contact is shown in FIG. 6*b*. During the further rotation 23 of the cam 21, the opening lever 20 and the driver 50 are pushed away, as can be seen in FIG. 8*b*. A stationary stop 25 in the lock housing ensures that the opening lever 20 can pivot out of its middle position 20.0 only to a certain extent during the opening phase and in particular ensures that, during the further rotation 23, it is not carried along by the cam 21. The driver 50 is moved around an angle 53 into a working position illustrated by the auxiliary line 50.1 in FIG. 8*b*. During the pivoting 53, a shoulder 55 on the driver tab 54 carries the pawl 40 along by acting on an opposing shoulder 45 on the pawl arm 46. The pawl 40 is thus pushed away against its spring-loading 42 from the rotary latch 30, and its locking end 41 is lifted out of the main catch 32 of the rotary latch 30 of FIG. 6*b*. Then, because of its spring-loading 36, the rotary latch 30 can pivot back outward into its open position 30.0, shown in FIG. 8*b*, which, as already described in conjunction with FIG. 1*a*, is defined by a stationary stop 37 in the housing. The closing part 35 is pushed out by the rotary latch 30 and is released, as shown in FIG. 8*b*. The hatch is released and can be opened completely.

FIGS. 6*a*-8*a* show what happens in the area of the closing lever 10 during the opening phase of the lock brought about by the opening lever 20. In these figures, for the sake of clarity, the components which are important for the operation of the opening aid itself, namely, the second cam 21, the opening lever 20, and the driver 50, have been omitted. When the second cam 21, during the opposite rotation 23, has arrived in the position of FIG. 6*b*, the first cam 11, seated on the same output shaft 12 of the gearbox, obviously will be in the position shown in FIG. 6*a*. The first cam 11 slides along over the butt end 14 of the closing lever 10, without being able to exert any effect on the pawl 40. The pawl 40 remains engaged with the main catch 32, as a result of which the main latching position 30.2 remains preserved at least initially. This does not change until after the transition from FIG. 6*b* to FIG. 8*b*. FIG. 7*a* shows an intermediate position of the first cam 11 during this opposite rotation 23, where the driver 50, only part of which is shown, has just now reached its working position 50.1 by the action of the opening lever 20. At the other end, however, the closing lever 10 is still resting against the first cam 11, for which reason, in FIG. 7*a*, the rotary latch 30 is still in its main latching position 30.2 in agreement with FIG. 5*a*. In FIG. 7*a*, the locking end 41 of the pawl 40 has released the main catch 32 of the rotary latch, because the shoulder 55 of the driver has already pushed away the pawl 40 by way of the opposing shoulder 45.

During the further rotation 23 of the two cams 11, 21 in FIG. 7*a*, however, the first cam 11 releases the closing lever 10. Nevertheless, the second cam 21 remains in contact with the opening lever 20. Thus the released rotary latch 30 has enough time to pivot back into its original open position 30.0, seen in FIG. 8, as a result of its spring-loading 36. The pawl 40 is not released by the cam 21 and thus its spring-loading 42 is not allowed to act until the second cam 21 has also released the opening lever 20. This occurs during the further rotation of the output shaft 12 in the opposite direction 23. The motor stops the opposite rotation 23 when the "12 o'clock" starting position of FIG. 1*a* has been reached again.

Figure 3B:
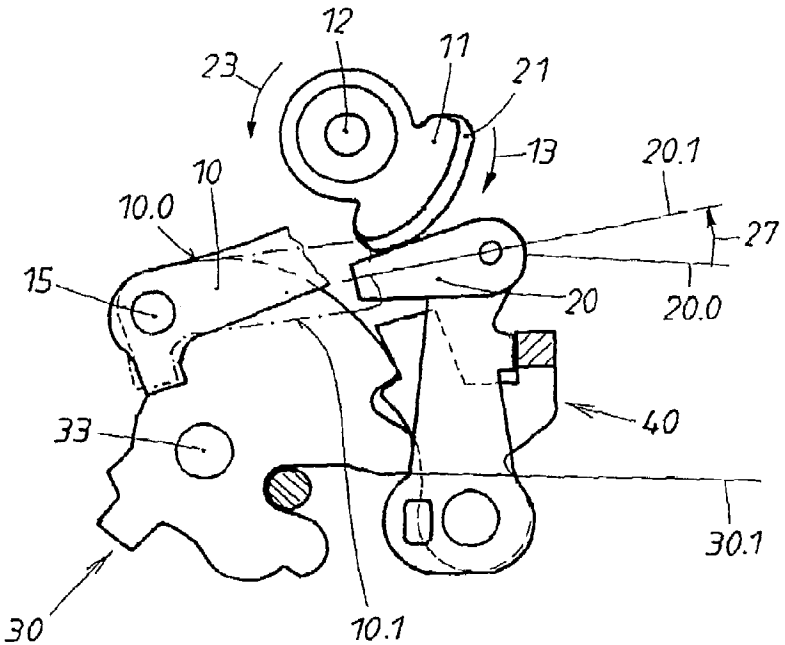

FIG. 3*b* also explains what happens to the lock parts of the opening aid when the output shaft 12 is rotated in the direction 13, i.e., the direction which causes the lock elements of FIGS. 1*a*-5*a* to close the hatch. During this rotation, which occurs in the clockwise direction 13, the opening lever 20 is pivoted freely against the action of its impulse spring out of its previously described middle position 20.0, which is also shown by the auxiliary line in FIG. 3*b*, into an angled position, marked by another auxiliary line 10.1. This is illustrated in FIG. 3*b* by the angle 27. This has no effect on the engagement of the pawl 40 in the rotary latch 30. Although only the prelatching position 30.1 is present in FIG. 3*b*, the same is also true when the two cams 11, 21 are driven jointly in the rotational direction 13, i.e., in the clockwise direction, and the rotary latch is in the main latching position.

The inventive lock allows access to the passenger compartment when the rear hatch is closed even if the motor and/or the power supply fails after the prelatching position 30.1 is reached. A failure of the motor of this type is shown in FIG. 9*a*. The cam 11 in this example has continued to move a short distance out of the prelatching position shown in FIG. 3*a* and, by acting on the closing lever 10', shown in dotted line, has brought about the pivot position 30' of the rotary latch indicated in dash-dot line. The dash-dot line rotary latch 30' is located in its intermediate position 30.5, illustrated by the auxiliary line 30.5. The cam 11 could have rotated further in the direction of the rotational arrow, also shown in dash-dot line.

By manually pushing the rear hatch against the action of the seal, the rotary latch 30 is now moved at least as far as its overstroke position 30.3 of FIG. 4*a* or possibly even to a "maximum end position", illustrated by the auxiliary line

30.4 in FIG. 10*a*. This end position 30.4 is determined by the contact of the shoulder 57 of the rotary latch 30, as illustrated in dash-dot line in FIG. 10*a*, with a stationary stop 47. Then the pawl 40 can be lifted out of the main catch 32 by emergency mechanical actuation (not shown). As a result, the rotary latch 30 is pivoted back by its spring-loading 36 into its open position 30.0, which is illustrated by a rotational arrow 29 in FIG. 9*a*. In the open position 30.0 of FIG. 9*a*, the rotary latch 30 has released the closing part 35. The rear hatch is open.

During this return pivoting movement 29 of the rotary latch out of the intermediate position 30.5 into the open position 30.0, the closing lever 10 strikes a projecting area 48 of the cam 11, which prevents it from bypassing the cam 11. The closing lever 10 is rotated in FIG. 9*a* against the force of its impulse spring 16 into an emergency position 10.2, in which the closing lever 10 is disconnected from the actual cam 11. If the motorized drive should then become active again, the cam 11 will easily be able to pass by as the closing lever 10 continues to turn.

As FIG. 9*a* shows, after the previously described emergency situation, the rotary latch 30 is in its proper open position 30.0, which is determined by the stationary stop 37, but the closing lever 10 in FIG. 9*a* is in the rotated emergency position 10.2 with respect to the middle position 10.0 of FIG. 1*a*. In FIG. 9*a*, the closing lever 10, because of the force 16 being exerted by its impulse spring, is supported against the previously mentioned cam area 48. Even if the motor in FIG. 9*a* remains out of service, the inventive lock can once again be returned to its operational starting situation (FIG. 1*a*) in the following way. This is explained on the basis of FIG. 10*a*.

Proceeding from FIG. 9*a*, the rear hatch is pushed shut again manually. As this happens, the closing part 35 travels into the rotary latch 30 and, as indicated by the arrow 49 in FIG. 10*a*, pivots the rotary latch again toward its overstroke position 30.3 or end position 30.4. In FIG. 10*a*, the rotary latch position shown by the auxiliary line 30.6 is enough to release the closing lever 10. That is, the lever 10 in FIG. 10*a* has been pivoted around its hinge point 15 on the rotary latch 30 so far back that its butt end 14 lies outside the rotational path of the cam 11 indicated by the rotational arrow 58. The closing lever 10, which was located initially in its emergency position 10.2 illustrated in dotted line in FIG. 10*a*, is returned automatically to its middle position 10.0 by its impulse spring loading 16. If, after this return movement of the closing lever in FIG. 10*a*, the rear hatch is opened and thus the pawl 40 is pivoted away from the rotary latch 30 as a result of renewed emergency mechanical actuation (not shown), the lock moves automatically back into its starting position shown in FIG. 1*a*. Regardless of when the motor starts to turn in the direction of rotational arrow 58 in FIG. 10*a*, the cam 11 can easily be returned to its proper starting position of FIG. 1*a*. During this further rotation 58 of the cam 11, there is no collision with the closing lever 10.

List of Reference Numbers

| | |
|---|---|
| 10 | closing lever |
| 10' | closing lever in the position according to 30.5 (FIG. 9a) |
| 10.0 | middle position of 10 (FIG. 3a) |
| 10.1 | working position of 10 (FIG. 3a) |
| 10.2 | emergency position of 10 with no supportive effect (FIG. 9a) |
| 11 | first cam for 10 |
| 12 | output shaft for 11, 21 |
| 13 | rotational arrow of 12 in one direction (clockwise direction) |

-continued

List of Reference Numbers

| | |
|---|---|
| 14 | butt end of 10 |
| 15 | hinge point of 10 on 30 (FIG. 3a) |
| 16 | pair of arrows of the impulse spring for 10 (FIG. 3a) |
| 17 | air gap between 54 and 56 (FIG. 6b) |
| 18 | pivot angle of 30 between FIGS. 3a and 4a |
| 19 | travel of 35 between 35.1 and 35.2 (FIG. 5a) |
| 20 | opening lever |
| 20.0 | middle position of 20 (FIG. 6b) |
| 20.1 | no-load position of 20 (FIG. 3b) |
| 21 | second cam for 20 |
| 22 | hinge point of 20 on 50 (FIG. 6b) |
| 23 | rotation in the opposite direction (counterclockwise direction) |
| 24 | butt end of 20 |
| 25 | stop pin for 20 (FIG. 8b) |
| 26 | pair of arrows of the impulse spring for 20 (FIG. 6b) |
| 27 | free angular movement of 20 at 13 (FIG. 6b) |
| 28 | arrow of the torque of 10 on 30 (FIG. 3a) |
| 29 | arrow of the return pivoting movement of 30 (FIG. 9a) |
| 30 | rotary latch |
| 30' | rotary latch at 30.5 (FIG. 9a) |
| 30.0 | open position of 30 (FIG. 1a) |
| 30.1 | prelatching position of 30 (FIG. 2a) |
| 30.2 | main latching position of 30 (FIG. 5a) |
| 30.3 | overstroke position of 30 (FIG. 4a) |
| 30.4 | end position of 30 (FIG. 10a) |
| 30.5 | intermediate position of 30' (FIG. 9a) |
| 30.6 | position of 30 upon release of 10 by 11 (FIG. 10a) |
| 31 | pre-catch on 30 |
| 32 | main catch on 30 |
| 33 | stationary axis for 30 |
| 34 | closing notch in 30 for 35 |
| 35 | closing part |
| 35.1 | prelatching position of 35 (FIG. 5a) |
| 35.2 | main latching position of 35 (FIG. 5a) |
| 36 | arrow of the spring-loading of 30 |
| 37 | stationary stop for 30 (FIG. 1a) |
| 38 | rotational angle of 30 between 30.0 and 30.1 (FIG. 2a) |
| 39 | contact point on 30 for 41 at 30.0 (FIG. 1a) |
| 40 | pawl |
| 41 | locking end of 40 |
| 42 | arrow of the spring-loading of 40 |
| 43 | stationary axis of 40 |
| 44 | air gap in the overstroke position (FIG. 4a) |
| 45 | opposing shoulder on 46 (FIG. 8b) |
| 46 | projecting arm on 40 (FIG. 6b) |
| 47 | stationary stop for 30 (FIGS. 9a, 10a) |
| 48 | cam area (FIG. 9a) |
| 49 | arrow of the pivoting of 30 from 30.0 toward 30.4 (FIG. 10a) |
| 50 | driver |
| 50.0 | rest position of 50 (FIG. 6b) |
| 50.1 | working position of 50 (FIG. 8b) |
| 51 | stationary stop for 50 (FIG. 6b) |
| 52 | arrow of the spring-loading of 50 (FIG. 6b) |
| 53 | pivot angle of 50 between 50.0 and 50.1 (FIG. 8b) |
| 54 | backward-extending tab on 50 (FIG. 6b) |
| 55 | shoulder on 54 (FIG. 8b) |
| 56 | air gap between 47 and 57 (FIG. 4a) |
| 57 | shoulder of 30 for 47 (FIG. 4a, 10a) |
| 58 | rotational path of 11 (FIG. 9a) |

The invention claimed is:

1. A lock for doors or hatches of vehicles, with a stationary (33) rotary latch (30), into which a closing part (35) travels when the door or hatch is closed manually, the rotary latch (30) thus being pivoted against its spring-loading (36) initially out of an open position (30.0) into a prelatching position (30.1);

with a stationary, rotatably supported (43) pawl (40), which is spring-loaded (42) toward the rotary latch (30) and which, when the rotary latch is in the prelatching position (30.1), drops into a pre-catch (31) provided on the rotary latch (30);

with a reversible motor, which acts by way of at least one cam (11, 21) both on a motorized closing aid and on a motorized opening aid;

where, when the motor rotates in one direction (13), the opening aid exerts no effect but the closing aid is active, pivoting the rotary latch (30) against its spring-loading (36) out of the prelatching position (30.1) into an overstroke position (30.3), the rotary latch (30) carrying the closing part (35) along with it until the spring-loaded pawl (40) drops behind the main catch (32) of the rotary latch (30);

in the overstroke position (30.3), the closing aid releases the rotary latch (30), as a result of which the spring-loading (36) moves the rotary latch (30) back until the pawl (40) rests against the main catch (32) of the rotary latch (30) and determines the main latching position (30.2) of the rotary latch (30); and when the motor rotates in the opposite direction (23), the closing aid exerts no effect but the opening aid is active, lifting the pawl (40) against its spring-loading (42) out of the main catch (32) and holding it until the rotary latch (30) pivots back under the action of its spring-loading (36) into the open position (30.0) and releases the closing part (35), wherein the closing aid consists of a closing lever (10) rotatably supported eccentrically (15) on the rotary latch (30), this lever being held in a middle position (10.0) by an impulse spring (16) and/or by control surfaces; where the closing lever (10), when in its middle position (10.0), projects into the rotational path of the cam (11) only in the prelatching position (30.1) and is carried along by the cam (11) upon rotation in the one direction (13); where the opening aid consists of a stationary, rotatably supported (43) driver (50) and an opening lever (20), rotatably supported (22) on the driver (50), the lever being held in a middle position (20.0) by an impulse spring (26) and/or by control surfaces; where the opening lever (20), when in the middle position (20.0), projects into the rotational path of the cam (21) in the main latching position (30.2) and is carried along by the cam (21) upon rotation in the opposite direction (23); and where the carried-along opening lever (20) pushes the pawl (40) away from the rotary latch (30) by way of the driver (50).

2. A lock according to claim 1, wherein the closing lever (10) is located outside the rotational path of the cam (11) both in the main latching position (30.2) and in the open position (30.0) of the rotary latch (30).

3. A lock according to claim 1, wherein, when the cam (11) rotates in the opposite direction (23), the closing lever (10), which projects into the rotational path of the cam (11) in the prelatching position (30.1), is pivoted away from its middle position (10.0) against the action of its impulse spring (16) and exerts no actuating pressure on the rotary latch (30).

4. Lock according to claim 1, wherein the opening lever (20) lies in the actuation path of the cam (21) both in the open position (30.0) and in the prelatching position (30.1) of the rotary latch (30); where during rotation in the one direction (13), the opening lever (20) is pivoted away (27) from its middle position (20.0) against the action of the impulse spring (26) and exerts no actuating pressure on the driver (50);

but, upon rotation in the opposite direction (23), is gripped by its cam (21) and pivots the driver (50) and the pawl (40) back (53) in the outward direction.

5. A lock according to claim 1, wherein, when the driver (50) is moved by the opening lever (20), its shoulder (55) meets an opposing shoulder (45) of the pawl (40) and thus carries the pawl (40) along, whereas the shoulder (55) is a certain free distance away from the opposing shoulder (45) both in the open position (30.0) and in the prelatching position (30.1).

6. A lock according to claim 5, wherein the shoulder (55) lies on a plane different from that of the driver (50) and/or in that the opposing shoulder (45) lies on a plane different from that of the pawl (40).

7. A lock according to claim 1, wherein, when the electronic control unit, the motor, and/or the power supply fails, the lock has emergency actuation, which lifts the pawl (40) out of the pre-catch (31) or main catch (32) of the rotary latch (30); and where when the power is restored, the further rotation (13, 23) of the cam or cams (11, 21) in the one direction (13) or in the opposite direction (23) can proceed until the point is reached at which the motor is turned off.

8. A lock according to claim 7, in which a stationary stop (47) determines a maximum end position (30.4) of the rotary latch (30), this end position being beyond the overstroke position (30.3), wherein when the electrical control unit, the motor, and/or the power supply fails after the prelatching position (30.1) has been reached, the hatch or door can be closed manually so that the closing part (10) will move the rotary latch (30) mechanically at least as far as its overload position (30.3) or end position (30.4);

then, by means of the emergency mechanical actuation, the pawl (40) is lifted out of the main catch (32) and the rotary latch (30) is pivoted back (29) by its spring-loading (36) into its open position (30.0); where when the rotary latch (30) pivots back (29), the closing lever (10) strikes an area (48) of the cam (11) and is initially rotated against the force of its impulse spring (16) into an emergency position (10.2) with no supportive effect; and where by manually pushing the hatch or door in again, the rotary latch (30) is pivoted (49) by the closing part (35) again out of its open position (30.0) toward its overstroke position (30.3) or end position (30.4), as a result of which the closing lever (10) is returned by its impulse spring (16) from the emergency position (10.2), past the interfering area (48) of the cam, to its middle position (10.0).

9. A lock according to claim 1, wherein the motor drives two cams (11, 21) simultaneously, one (11) of which works together with the closing lever (10), the other (21) with the opening lever (20).

10. A lock according to claim 9, wherein the two cams (11, 21) are coaxial to each other and are seated on the same gearbox output of the motor.

11. A lock according to claim 9, wherein the two cams (11, 21) are mounted a certain distance apart and are seated on different gearbox components of the motor.

12. A lock according to claim 1, wherein a common cam is assigned to the closing lever (10) and to the opening lever (20).

13. A lock according to claim 1, wherein the closing lever (10) lies in a plane different from that of the opening lever (20).

14. A lock according to claim 1, wherein the closing lever (10) and/or the opening lever (20) are cranked, as a result of which the butt ends (14, 24) of the two levers (10, 20) working together with the cam or cams (11, 21) lie in planes different from that of the bearing end of these levers (10, 20).

15. A lock according to claim 1, wherein the pivotable driver (50) and the pawl (40) are supported on a common, stationary axis (43).

* * * * *